US008430284B2

(12) United States Patent
Broadbent et al.

(10) Patent No.: US 8,430,284 B2
(45) Date of Patent: Apr. 30, 2013

(54) INSULATED CARRIERS FOR BULK BEVERAGE CONTAINERS HAVING SPIGOTS, SPOUTS OR THE LIKE

(75) Inventors: Craig Broadbent, Fairview Park, OH (US); Kim Bernth, Loveland, OH (US)

(73) Assignee: Stable Brands LLC, Fairview Park, OH (US)

( * ) Notice: Subject to any disclaimer, the term of this patent is extended or adjusted under 35 U.S.C. 154(b) by 352 days.

(21) Appl. No.: 12/641,463

(22) Filed: Dec. 18, 2009

(65) Prior Publication Data

US 2010/0155437 A1 Jun. 24, 2010

Related U.S. Application Data

(60) Provisional application No. 61/139,043, filed on Dec. 19, 2008.

(51) Int. Cl.
*B65D 81/38* (2006.01)
*A45F 5/00* (2006.01)
*A45F 3/16* (2006.01)

(52) U.S. Cl.
USPC ..... 224/148.4; 222/566; 224/148.3; 224/148.1; 383/66; 383/906

(58) Field of Classification Search ..... 383/66, 383/906, 110; 224/148.1, 148.3, 148.4, 148.5, 224/148.6; 220/833, 566; 222/166, 183, 222/566; D7/392, 607; D9/435, 477; 62/457.4, 62/457.8, 398
See application file for complete search history.

(56) References Cited

U.S. PATENT DOCUMENTS

| | | | | |
|---|---|---|---|---|
| 1,999,670 | A * | 4/1935 | Strouse et al. | 62/372 |
| 2,748,047 | A * | 5/1956 | Kuss | 428/137 |
| 2,981,443 | A * | 4/1961 | Baldwin | 222/183 |
| 3,443,397 | A | 5/1969 | Donovan et al. | |
| 3,453,033 | A * | 7/1969 | Davis | 312/35 |
| 3,480,182 | A * | 11/1969 | Rigor | 221/288 |
| 4,197,890 | A * | 4/1980 | Simko | 383/97 |
| 4,802,602 | A * | 2/1989 | Evans et al. | 220/739 |
| 4,812,054 | A | 3/1989 | Kirkendall | |
| 4,870,837 | A * | 10/1989 | Weins | 62/457.4 |
| 4,953,818 | A | 9/1990 | Contant | |
| D341,779 | S * | 11/1993 | Lewis | D9/435 |
| 5,329,787 | A * | 7/1994 | Friday | 62/389 |
| 6,082,896 | A * | 7/2000 | Pulli | 383/6 |
| D444,063 | S * | 6/2001 | Buck et al. | D9/447 |
| 6,334,329 | B1 | 1/2002 | Weller | |
| 6,446,577 | B1 * | 9/2002 | Salahor | 119/497 |
| 6,536,637 | B1 * | 3/2003 | McLaughlin | 224/148.3 |
| D502,360 | S | 3/2005 | Kautz | |

(Continued)

*Primary Examiner* — Nathan J Newhouse
*Assistant Examiner* — Matthew Theis
(74) *Attorney, Agent, or Firm* — Porter, Wright, Morris & Arthur, LLP

(57) ABSTRACT

A carrier for a bulk beverage container having a spout includes a shell having walls forming a hollow interior space sized and shaped for receiving the bulk beverage container therein, an opening formed in one of the walls for passage of the spout therethrough, and a flap secured to the shell for selectively covering the opening. The flap hinges between a closed position wherein the flap covers the opening and an open position wherein the flap does not cover the opening. A gasket can be provided at the opening for closely receiving the spout to seal the opening about the spout. Fasteners, such as hook-and-loop type fasteners, can be provided for removably securing the flap in the closed and open positions.

19 Claims, 6 Drawing Sheets

U.S. PATENT DOCUMENTS

D531,458 S * 11/2006 Lown et al. ..... D7/605
7,137,533 B1 11/2006 Heath
D547,545 S * 7/2007 Boehm et al. ..... D3/202
D585,705 S * 2/2009 Weers et al. ..... D7/607

* cited by examiner

INSULATED CARRIERS FOR BULK BEVERAGE CONTAINERS HAVING SPIGOTS, SPOUTS OR THE LIKE

CROSS-REFERENCE TO RELATED APPLICATIONS

This application claims the priority benefit of U.S. Provisional Patent Application No. 61/139,043 filed on Dec. 19, 2008, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The field of the present invention generally relates to insulated carriers for beverages and, more particularly, insulated carriers for bulk beverage containers having spigot or spout dispensers or the like.

BACKGROUND OF THE INVENTION

Many beverages are sold in bulk containers in order to reduce costs for relatively high quantity users of the beverages. For example, wine is often sold in rectangular cardboard boxes typically sized to hold about three or four liters and beer is often sold in cylindrical metal cans (often referred to as "mini kegs") typically sized to hold about five liters. These bulk containers typically have spigot or spout dispensers located near bottom edges of the containers. The relatively large sizes of these containers make them well suited for use at parties, picnics, tailgates and the like. The construction of these containers also makes them ideal for use at locations which do not permit glass bottles and/or cans such as some parks and beaches.

While these bulk containers have many advantages, they have poor insulating properties and are difficult to operate when located in conventional ice chests, coolers, and the like. As a result, there have been attempts to construct special purpose coolers and the like for these bulk containers. For example, see U.S. Pat. Nos. 4,812,054, 6,334,329, 7,137,533, and D502,360, the disclosures of which are expressly incorporated herein in their entireties by reference. While these special purpose coolers may somewhat serve their intended purpose of insulating the containers during use, they provide no protection for the spigot or spout and are useful only for the very limited purpose insulating a specific bulk beverage container. Accordingly, there is a need in the art for an improved insulated carrier for bulk beverage containers.

SUMMARY OF THE INVENTION

Disclosed are insulated carriers or coolers for bulk beverage containers having spigots, spouts or the like which address one or more issues of the related art. A disclosed carrier comprises, in combination, a shell having walls forming a hollow interior space sized and shaped for receiving the bulk beverage container therein, an opening formed in one of said walls for passage of the spout therethrough, and a flap secured to said shell for selectively covering the opening.

Additionally disclosed herein is a carrier for a bulk beverage container having a spout wherein the carrier comprises, in combination, a shell having walls forming a hollow interior sized and shaped for receiving the bulk beverage container therein, an opening formed in one of said walls for passage of the spout therethrough, and a gasket at the opening for closely receiving the spout to seal the opening about the spout.

Further disclosed herein is carrier for a bulk beverage container having a spout wherein the carrier comprising, in combination, a shell having walls forming a hollow interior space sized and shaped for receiving the bulk beverage container therein, an opening formed in one of said walls for passage of the spout therethrough, and a flap secured to said shell for selectively covering the opening. The flap hinges between a closed position wherein the flap covers the opening and an open position wherein the flap does not cover the opening. A gasket is provided at the opening for closely receiving the spout to seal the opening about the spout.

From the foregoing disclosure and the following more detailed description of various preferred embodiments it will be apparent to those skilled in the art that the present invention provides a significant advance in the technology and art of insulated carriers for bulk beverage containers. Particularly significant in this regard is the potential the invention affords for providing a high quality, reliable, low cost insulated carrier having desired operating features. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
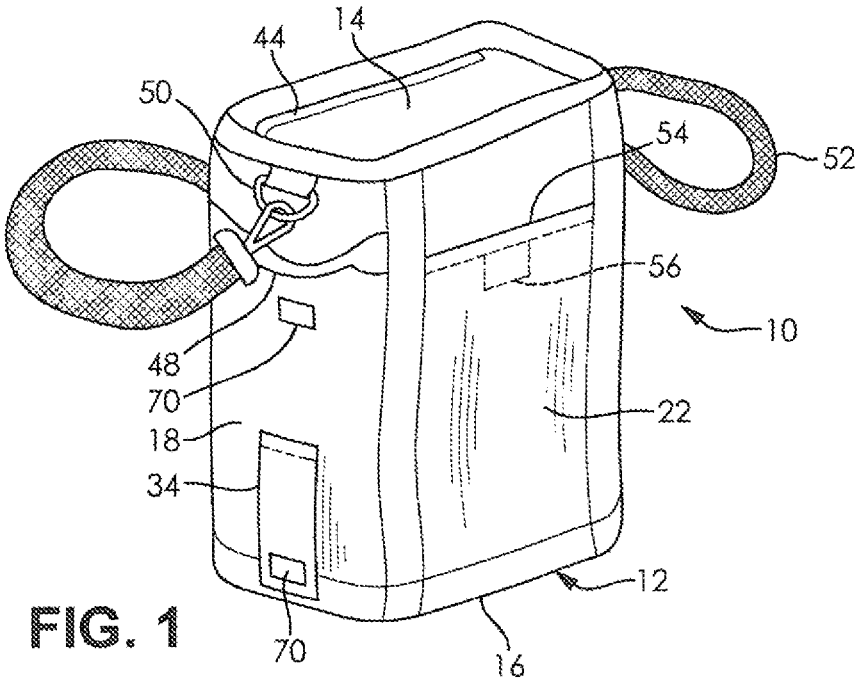
FIG. 1 is a perspective view of an insulated carrier for a bulk beverage container according to a preferred embodiment of the present invention, wherein a protective flap is in a closed position.
Figure 2:
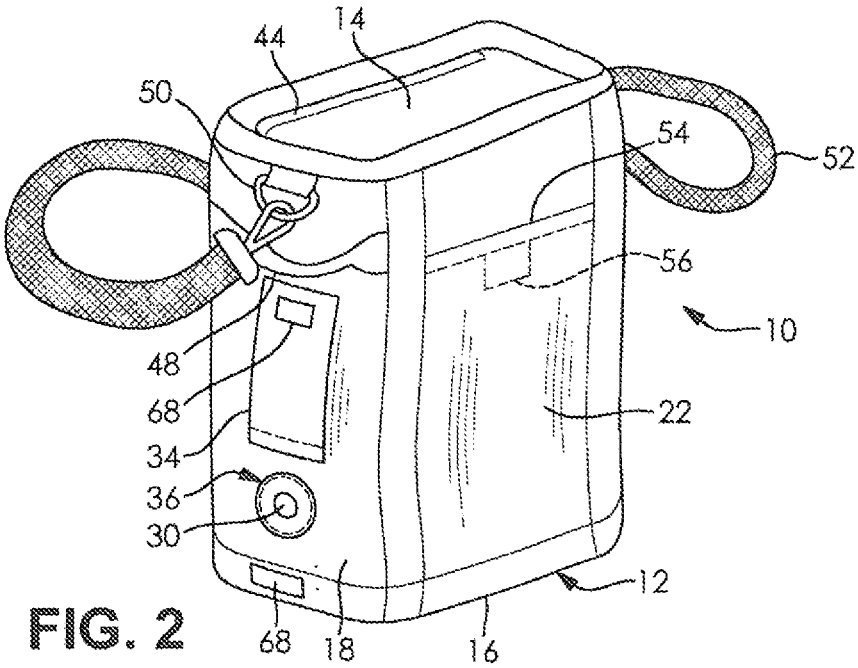
FIG. 2 is a perspective view of the insulated carrier of FIG. 1, wherein the protective flap is in an open position.
Figure 3:
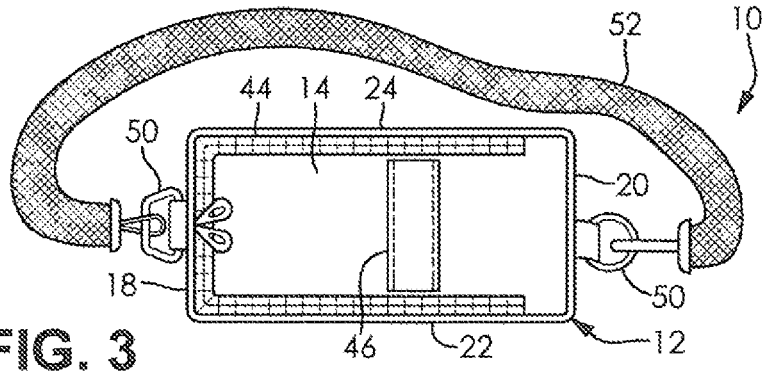
FIG. 3 is a top plan view of the insulated carrier of FIGS. 1 and 2.
Figure 4:
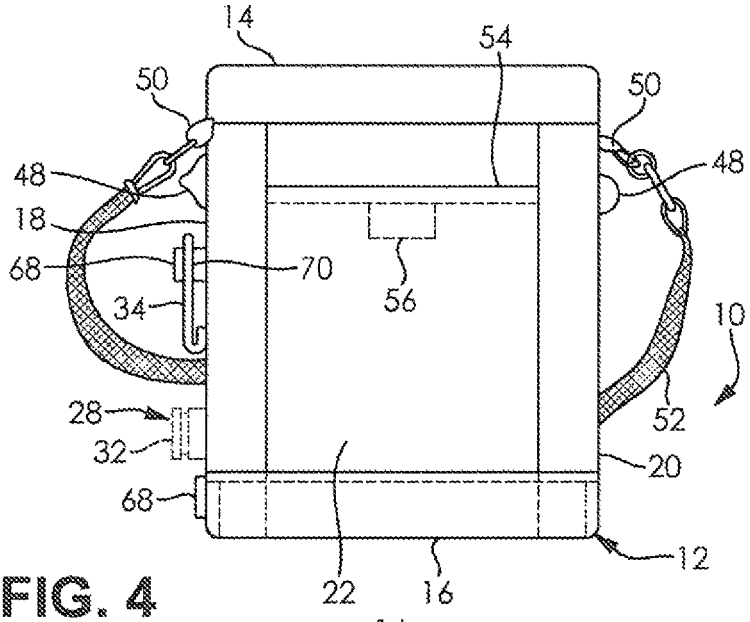
FIG. 4 is a left-side elevational view of the insulated carrier of FIGS. 1 to 3.
Figure 5:
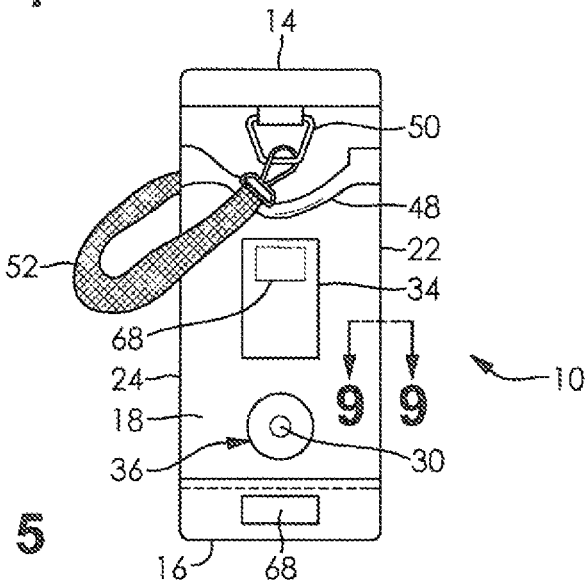
FIG. 5 is a front elevational view of the insulated carrier of FIGS. 1 to 4.

It should be understood that the appended drawings are not necessarily to scale, presenting a somewhat simplified representation of various preferred features illustrative of the basic principles of the invention. The specific design features of the insulated carrier as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the insulated carriers illustrated in the drawings. In general, up or upward generally refers to an upward direction within the plane of the paper in FIG. 4 and down or downward generally refers to a downward direction within the plane of the paper in FIG. 4. Also in general, fore or forward refers to a direction toward the spot opening, that is, generally toward the left in FIG. 4 and aft or rearward refers to a direction opposite the spout opening, that is, generally toward the right in FIG. 4.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved insulated carriers disclosed herein. The following detailed discussion of various alternative and preferred embodiments will illustrate the general principles of the invention with reference to wine boxes and beer mini kegs. Other embodiments suitable for other applications will be apparent to those skilled in the art given the benefit of this disclosure.

Referring now to the drawings, FIGS. 1 to 5 show an insulated carrier or cooler 10 according to a preferred embodiment of the present invention. The illustrated insulated carrier 10 includes a shell 12 having walls 14, 16, 18, 20, 22, and 24 forming a hollow interior space 26 sized and shaped for receiving a bulk beverage container 28 therein, an opening 30 formed in one of the walls 14, 16, 18, 20, 22, and 24 for passage of a spout 32 of the bulk beverage container 28 therethrough, a flap 34 secured to the shell 12 for selectively covering the opening 30, and a gasket 36 secured to the wall 14, 16, 18, 20, 22, and 24 at the opening 30 for closely receiving the spout 32 to seal the opening 30 about the spout 32.

Figure 9:
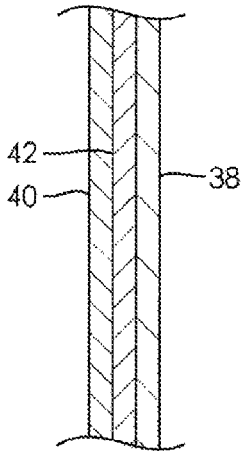
FIG. 9 is a section view taken along line 9-9 in FIG. 5.
Figure 10:
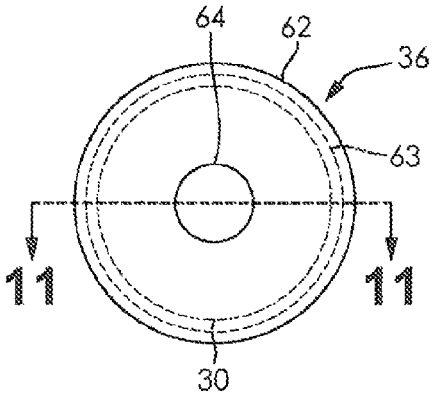
FIG. 10 is a fragmented, enlarged elevational view of a portion of FIG. 5 in the area of a gasket.

The illustrated shell 12 is rectangular shaped having top 14, bottom 16, front 18, rear 20, left side 22, and right side walls 24. The illustrated walls 14, 16, 18, 20, 22, and 24 form the rectangular shaped hollow interior space 26 sized and shaped for closely receiving a boxed wine type bulk beverage container 28 therein. It is noted that the walls 14, 16, 18, 20, 22, and 24 can be sized and/or shaped for receiving any other suitable type of bulk beverage container 28. As best shown in FIG. 9, the illustrated walls 14, 16, 18, 20, 22, and 24 include a protective outer layer 38, a liquid-impervious or liquid-proof inner layer 40, and an insulation layer 42 located between the outer and inner layers 38, 40. The outer layer 38 preferably comprises a fabric or cloth but alternatively can comprise any other protective suitable material. The inner layer 40 preferably comprises a plastic material but alternatively can comprise any other suitable water impervious material. The insulation layer 42 can comprise any suitable insulation material. It is noted that any other suitable type and quantity of layers 38, 40, 42 can be utilized. The walls 14, 16, 18, 20, 22, and 24 can be secured together in any suitable manner such as, for example, by stitching or sewing. Suitable exterior dimensions for an insulated carrier designed to hold a standard wine box can be a width of about 5.81 inches, a height of about 12.28 inches, and a length of about 11.31 inches.

The illustrated top wall 14 is operably attached to the shell 12 to selectively provide access to the interior space 26. The illustrated top wall 14 is secured to the shell with a zipper 44 extending along its left, front, and rights sides so that it hingedly opens about its rear side when the zipper 44 is opened. It is noted that access to the interior space 26 can alternatively be provided at other suitable locations and/or other suitable manner. The illustrated top wall 14 is also provided with a laterally extending loop handle 46 for holding the carrier 10. The illustrated front and rear walls 18, 20 are also provided with laterally extending loop handles 48 near the top of the shell 12 for alternatively holding the carrier 10. The illustrated front and rear walls 18, 20 are further provided with connectors 50 near the top of the shell 12 for releasably securing a shoulder strap 52 for alternatively holding the carrier 10. It is noted that the shell 12 can alternatively be configured with any other suitable means for holding the carrier 10. The illustrated left side wall 22 is provided with a pocket 54 open at its upper end and releasably closed with a hook and loop type fastener 56. It is noted that any other suitable quantities or locations of external pockets 54 can alternatively be utilized and any other suitable type of releasable fastener 56 can be alternatively used to selectively secure the pocket 56 in a closed manner.

Figure 6:
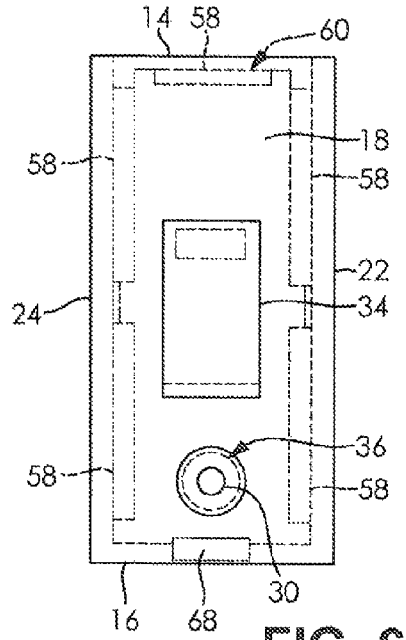
FIG. 6 is a top schematic view of the insulated carrier of FIGS. 1 to 5, wherein preferred gasket and ice pack locations are shown.
Figure 7:
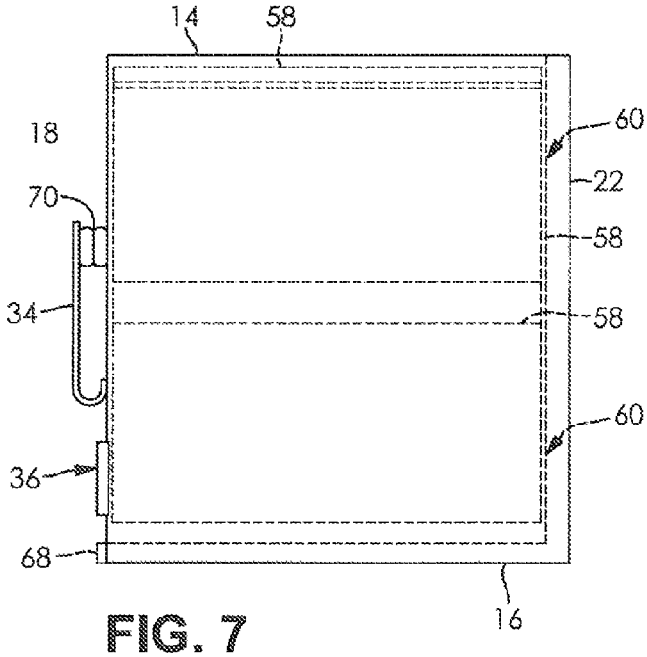
FIG. 7 is a left-side schematic view of the insulated carrier of FIGS. 1 to 5, wherein preferred gasket and ice pack locations are shown.
Figure 8:
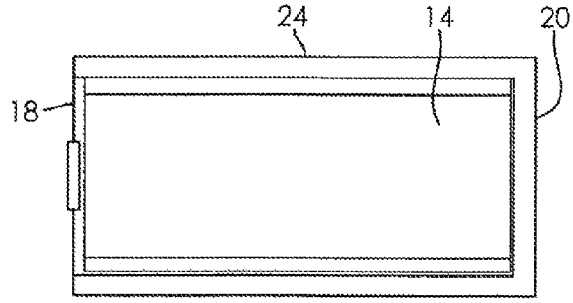
FIG. 8 is a front schematic view of the insulated carrier of FIGS. 1 to 5, wherein preferred gasket and ice pack locations are shown.

As best shown in FIGS. 6 to 8, the interior space 26 of the shell 12 is preferably sized to receive the bulk beverage container 28 with reusable ice or cold packs 58 located about the bulk beverage container 28 within the carrier 10. The illustrated interior space 26 is sized to position reusable ice or cold packs 58 on the left and right sides of the bulk beverage container 28, to the rear of the bulk beverage container 28, and on the top of the bulk beverage container 28. It is noted that any other suitable location, combination of locations, or quantity of reusable ice or cold packs 58 can alternatively be utilized. Preferably, pockets or pouches 60 are provided within the interior space 26 to hold the reusable ice or cold packs 58 at the desired locations.

The illustrated front wall 18 has the opening 30 formed therein for passage of the spout 32 through the front wall 18. The illustrated 30 opening is circular shaped but any other suitable shaped can be utilized. The illustrated opening 30 is located in the front wall 18 near its lower edge in order to cooperate with the spout 32 of the illustrated bulk beverage container 28. It is noted that the opening 30 can be located at other positions depending on the location of the spout 32 of the particular bulk beverage container 28 to be utilized.

Figure 12:
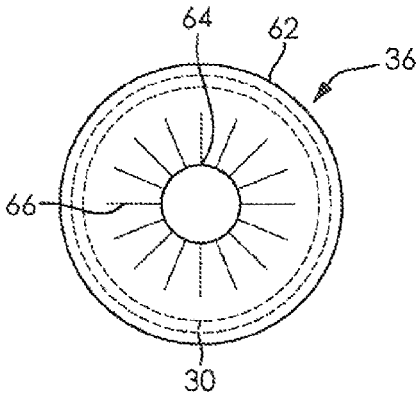
FIG. 12 is a fragmented, enlarged elevational view similar to FIG. 10 but showing an a variation of the gasket.
Figure 11:
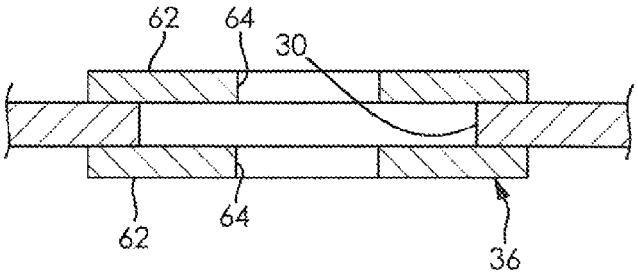
FIG. 11 is a sectional view taken along line 11-11 in FIG. 10.

As best shown in FIGS. 11 and 12, the gasket 36 is located at the opening 30 for closely receiving the spout 32 to seal the opening 30 about the spout 32. The illustrated gasket 36 includes a pair of gasket members 62 located on opposite sides of the front wall 18 at the opening 30. It is noted however, that alternatively the gasket 36 can comprise only one gasket member 62 on either side of the front wall 18. The illustrated gasket members 62 are circular with a central opening 64 so that they are annular or ring shaped. The gasket members 62 preferably have an outer diameter larger than the wall opening 30 and an inner diameter smaller than the wall opening 30. The inner diameter or central opening 64 is sized for closely receiving the spout 32 to form a seal therewith. It is noted that the gasket members 62 can alternatively have any other suitable form. The illustrated gasket members 62 are secured to the front wall 18 by sewing or stitching 63 but can alternatively be secured to the front wall 18 in any other suitable manner such as, for example, adhesive or the like. A gasket member 62 for a standard wine box can have the dimensions of an outer diameter of about 1.75 inches, an inner diameter of about 0.75 inches, a thickness of about 0.13 inches, and a stitching diameter of about 1.50 inches. The gasket members 62 preferably comprise a suitable resiliently flexible material to form the seal such as, for example, rubber, elastomer, plastic, Nylon, or the like but can alternatively be any other suitable material.

Figure 13:
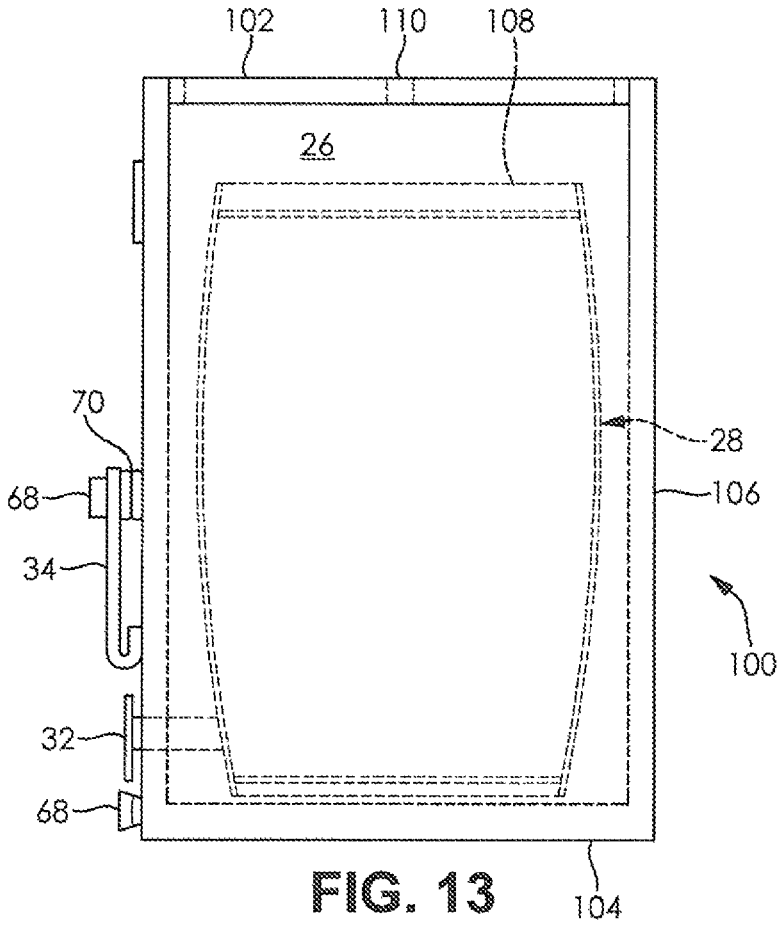
FIG. 13 is a left-side schematic view of an insulated carrier for a bulk beverage container according to a second preferred embodiment of the present invention.

As best shown in FIG. 13, the gasket members 62 can be provided with a plurality of radially extending slits 66 at the inner diameter 64 for making the gasket members 62 more flexible and/or easing insertion and withdrawal of the spout 32 and thus enabling a tighter fit with the spout 32 to form the seal. It is noted that the gasket members 62 can comprise relatively non-flexible materials and still form an adequate seal when the radial slits 66 are provided.

As best shown in FIGS. 1 to 5, the illustrated flap 34 is rectangular shaped and is hingedly secured to the shell 12 for selectively covering the opening 30 and the spout 32. The illustrated flap 34 is secured to the front wall 18 at its upper end above the wall opening 30 so that the flap 34 selectively hinges between a closed position wherein the flap 34 extends downwardly to entirely cover the opening 30 and an open position wherein the flap 34 extends upwardly and does not cover any portion of the opening 30. The illustrated flap 34 is formed of a material similar to the outer layer 38 but any other suitable material can alternatively be utilized. The illustrated flap 34 is secured to the front wall 18 by stitching or sewing but can alternatively be secured in any other suitable manner.

The flap 34 is preferably sized and shaped to cover the opening 30 and the spout 32 when the flap 34 is in the closed position and the bulk beverage container 28 is located in the shell 12. Thus, the flap 34 can provide protection and coverage of the spout 32 when the spout 32 is not in use and the flap 34 is closed. The flap 34 is also sized and shaped to cover the opening 30 when the flap 34 is in the closed position and the bulk beverage container 28 is not located in the shell 12. With the opening closed 30 by the flap 34, the carrier 10 can have multiple purposes, that is, can be used for items other than just the intended bulk beverage container 28.

A first fastener 68 is provided for removably securing the flap 34 in the closed position. The illustrated first fastener 68 comprises a hook-and-loop type fastener but any other suitable type of fastener can alternatively be utilized such as, for example, a snap, button, band, hook, or the like. A second fastener 70 is provided for removably securing the flap 34 in the open position. The illustrated second fastener 70 comprises a hook-and-loop type fastener but any other suitable type of fastener can alternatively be utilized such as, for example, a snap, button, band, hook, or the like.

Figure 14:
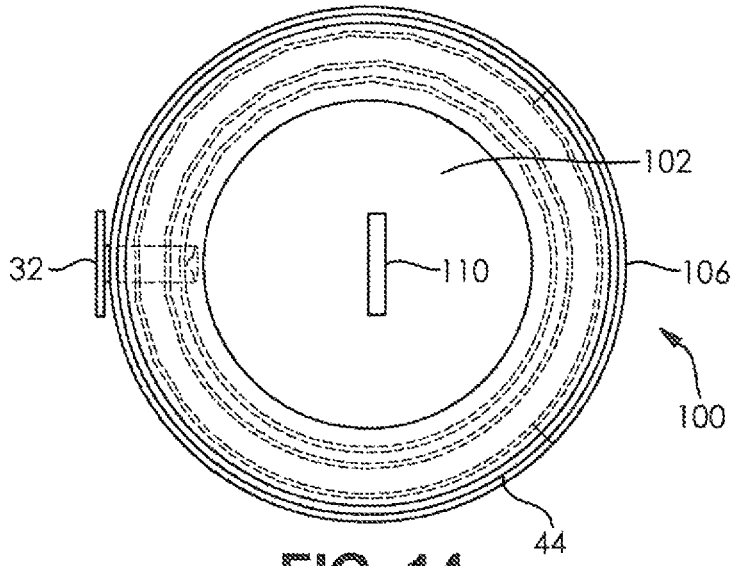
FIG. 14 is a top schematic view of the insulated carrier of FIG. 13.

FIGS. 13 and 14 show an insulated carrier 100 according to a second preferred embodiment of the present invention. The insulated carrier 100 according to the second embodiment of the invention has a cylindrical shaped shell 12. The illustrated top, bottom and side walls 102, 104, 106 form a cylindrical shaped hollow interior space 26 sized and shaped for receiving a beer mini keg type bulk beverage container 28 therein. The illustrated mini keg has a spout 32 near its lower edge and a pressure valve 108 in its top wall 102. As a result, the side wall 106 is provided with the opening 30 and the flap 34, and the top wall 102 is provided with a ventilation opening 110. Suitable exterior dimensions for an insulated carrier designed to hold a mini keg can be a diameter of about 8.26 inches and a height of about 12.26 inches. The insulated carrier 100 according to the second embodiment of the invention illustrates that the bulk beverage container 28, and as a result the shell 12 of the carrier 100, can have other suitable shapes.

Figure 15:
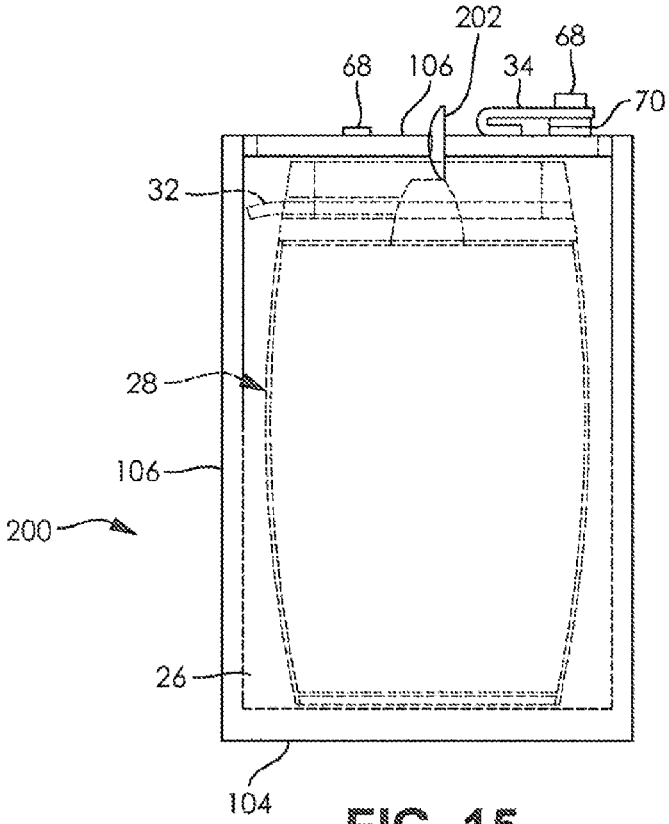
FIG. 15 is a left-side schematic view of an insulated carrier for a bulk beverage container according to a third preferred embodiment of the present invention.
Figure 16:
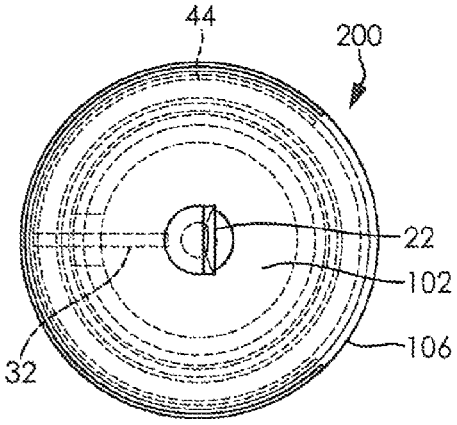
FIG. 16 is a top schematic view of the insulated carrier of FIG. 15, wherein details of the protective flap are removed for clarity.
Figure 17:
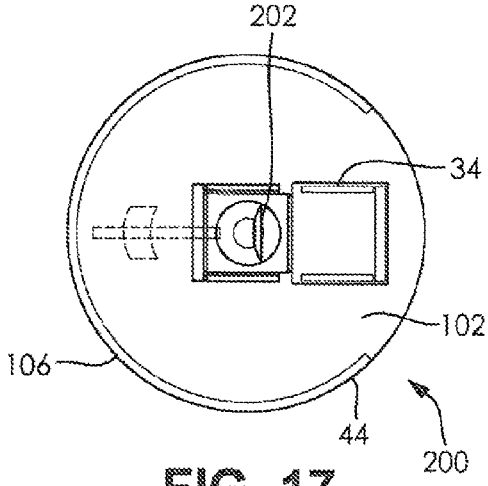
FIG. 17 is a top schematic view of the insulated carrier of FIGS. 15 and 16, wherein the protective flap is in an open position.

FIGS. 15 to 17 show an insulated carrier 200 according to a third preferred embodiment of the present invention. The insulated carrier 200 according to the second embodiment of the invention also has a cylindrical shaped shell 12. The illustrated walls 102, 104, 106 form a cylindrical shaped hollow interior space 26 sized and shaped for receiving a second form of a beer mini keg type bulk beverage container therein. The illustrated mini keg has a spout 32 and actuator 202 in its top wall. As a result, the opening 30 and flap 34 are provided in the top wall 102. The illustrated opening is generally square and the illustrated flap 34 is provided with hook and loop fastener on each of its nonattached sides. Suitable dimensions for the opening 30 can be a length of about 2.00 inches and a width of about 2.00 inches. Suitable dimensions for the flap 34 can be a length of about 2.38 inches and a width of about 2.50 inches. Suitable exterior dimensions for an insulated carrier designed to hold a mini keg can be a diameter of about 8.26 inches and a height of about 12.26 inches. The insulated carrier 200 according to the third embodiment of the invention illustrates that the spout 32 of the bulk beverage container 28, and as a result the opening 30 and flap 34 of the carrier 200, can have other suitable locations.

It is noted that each of the features and variations of the above-described embodiments of the invention can be used in any combination with any of the other above-described embodiments It is apparent from the above detailed description of preferred embodiments of the present invention, that the insulated carrier 10, 100, 200 of the present invention provides protection for the spout 32 by providing a flap 34 that can cover the spout 34 and the insulated carrier 10, 100, 200 can be easily used to carry any other food or beverage items because the insulated carrier 10, 100, 200 can act as a generic insulated carrier 10, 100, 200 when the flap 34 is covering the opening 30. It is also apparent that the insulated carrier 10, 100, 200 of the present invention provides improved insulating properties by sealing the spout opening 30 with a gasket 36.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A carrier for a bulk beverage container having a spout, said carrier comprising, in combination:

a shell having walls forming a hollow interior space sized and shaped for receiving the bulk beverage container therein;

a spout opening formed in one of said walls for passage of the spout therethrough;

a flap secured to the shell for selectively covering the spout opening;

wherein said flap is selectively moved between a closed position wherein said flap covers said spout opening and an open position wherein said flap does not cover said spout opening;

wherein the flap is sized and shaped to cover the spout opening and the spout when the flap is in the closed position and the bulk beverage container is located in the shell with the spout extending out of the spout opening so that the flap provides protection and coverage of the spout and the flap is also sized and shaped to cover the spout opening when the flap is in the closed position and the bulk beverage container is not located in the shell so that the shell can be used for items other than the bulk beverage container;

a first fastener cooperating between said flap and said one of said walls having said spout opening therein to removably secure said flap in said closed position when said spout is extending out of said spout opening and when said spout is not extending out of said spout opening;

a second fastener cooperating between said flap and said one of said walls having said spout opening therein to removably secure said flap in said open position; and wherein said first and second fasteners secure said flap to said one of said walls having said spout opening therein on opposite sides of said spout opening.

2. The carrier according to claim 1, wherein said flap hinges between said closed position wherein the flap covers the spout opening and an open position wherein the flap does not cover the spout opening.

3. The carrier according to claim 2, wherein said one of said walls having said spout opening therein is a side wall and said first fastener is located below the spout opening and the second fastener is located above the spout opening.

4. The carrier according to claim 3, wherein the first and second fasteners each comprise a hook-and-loop type fastener.

5. The carrier according to claim 1, wherein said flap is sized and shaped to cover both said spout opening and said spout extending therethrough when said flap is removably secured in said closed position.

6. The carrier according to claim 1, wherein the first and second fasteners each comprise a hook-and-loop type fastener.

7. The carrier according to claim 1, wherein said first and second fasteners secure said flap to said one of said walls having said spout opening therein on opposite sides of said spout opening.

8. The carrier according to claim 7, wherein the first and second fasteners each comprise a hook-and-loop type fastener.

9. The carrier according to claim 1, further comprising an annular-shaped gasket secured to said one of said walls having said spout opening therein at and encircling the spout opening for receiving the spout and engaging said spout to seal the spout opening about said spout.

10. The carrier according to claim 9, wherein the gasket comprises first and second gasket members secured to opposite sides of the wall forming the spout opening.

11. The carrier according to claim 1, wherein the shell is rectangular shaped.

12. The carrier according to claim 1, wherein the shell is cylindrical shaped.

13. A combination of a carrier and a bulk beverage container, said combination comprising, in combination:

a bulk beverage container having a spout;

a carrier comprising:

a shell having walls forming a hollow interior space with the bulk beverage container located therein;

a spout opening formed in one of said walls with the spout extending therethrough;

a flap secured to the shell for selectively covering the spout opening and the spout;

wherein said flap selectively hinges between a closed position wherein the flap covers the spout opening and the spout and an open position wherein the flap does not cover the spout opening and the spout;

wherein the flap is sized and shaped to cover the spout opening and the spout when the flap is in the closed position and the bulk beverage container is located in the shell with the spout extending out of the spout opening so that the flap provides protection and coverage of the spout and the flap is also sized and shaped to cover the spout opening when the flap is in the closed position and the bulk beverage container is not located in the shell so that the shell can be used for items other than the bulk beverage container;

a first fastener cooperating between said flap and said one of said walls having said spout opening therein to removably secure said flap in said closed position when said spout is extending out of said spout opening and when said spout is not extending out of said spout opening; and a second fastener cooperating between said flap and said one of said walls having said spout opening therein to removably secure said flap in said open position;

an annular-shaped gasket secured to said one of said walls having said spout opening therein at and encircling the spout opening for closely receiving the spout to seal the spout opening about the spout.

14. The carrier according to claim 13, wherein the gasket comprises first and second gasket members secured to opposite sides of the wall forming the spout opening.

15. The carrier according to claim 13, wherein the gasket comprises a resiliently flexible material different than a material forming the shell.

16. The carrier according to claim 13, wherein the gasket has a central opening for passage of the spout therethrough and a plurality of slits extending radially outward from the central opening.

17. The carrier according to claim 13, wherein the shell is rectangular shaped.

18. The carrier according to claim 13, wherein the shell is cylindrical shaped.

19. The combination according to claim 13, wherein said annular-shaped gasket has a circular-shaped central opening sized smaller than the spout opening.

* * * * *